United States Patent [19]

Kuroda et al.

[11] 4,028,006

[45] June 7, 1977

[54] BUCKET COVER ATTACHMENT

[75] Inventors: Michio Kuroda; Kiyoshi Namura; Fumio Kato; Yoshiaki Yamazaki, all of Hitachi; Tutomu Iwasaki, Mito; Akira Ishida, Hitachi; Akio Sohma, Hitachi; Tetsu Imai, Hitachi, all of Japan

[73] Assignee: Hitachi, Ltd., Japan

[22] Filed: Jan. 20, 1976

[21] Appl. No.: 650,768

[30] Foreign Application Priority Data

Jan. 24, 1975 Japan ..... 50-9772

[52] U.S. Cl. ..... 416/191; 416/195

[51] Int. Cl.[2] ..... F01D 5/22

[58] Field of Search ..... 416/189–191, 416/194, 195, 196

[56] References Cited

UNITED STATES PATENTS

| | | | |
|---|---|---|---|
| 3,314,652 | 4/1967 | Geberth et al. | 416/196 |
| 3,572,968 | 3/1971 | Musick et al. | 416/191 |
| 3,837,761 | 9/1974 | Brown | 416/191 |

FOREIGN PATENTS OR APPLICATIONS

| | | | |
|---|---|---|---|
| 38,086 | 3/1968 | Japan | 416/196 |

*Primary Examiner*—Everette A. Powell, Jr.
*Attorney, Agent, or Firm*—Craig & Antonelli

[57] ABSTRACT

A plurality of turbine buckets annularly arranged around a rotor are each provided with a ledge disposed at right angles to the outer surface of each bucket. Each ledge includes a leading end portion and a trailing end portion each formed therein with a vertical hole, leading and trailing end portions of the ledge of each turbine bucket extending in opposite directions on both sides of the bucket. There are provided cover pieces each interposed between ends of the adjacent two turbine buckets and formed on the upper surface with a plurality or cylindrical projections adapted to be loosely received in the vertical holes formed in the ledges of the adjacent two turbine buckets. Contact surfaces adapted to be brought into contact with the undersides of the ledges are formed on the upper surface of each cover piece and interposed between the cylindrical projections, and an upper end portion of at least one of the cylindrical projections is machined to provide an enlarged diameter projection portion so as to preclude dislodging of the projection from the hole whereby the cover piece can positively connect the adjacent two buckets together.

13 Claims, 9 Drawing Figures

BUCKET COVER ATTACHMENT

This invention relates to the construction of a bucket wheel for use with a steam turbine or gas turbine, and more particularly it is concerned with a bucket cover attachment which interconnects the adjacent two turbine buckets while being maintained in engagement with the turbine buckets such that movements of the bucket cover attachment relative to the turbine buckets are allowed to some extent when the turbine buckets undergo twisting and untwisting.

In one type of bucket cover attachment known in the art, there is provided a diagonal cover piece extending diagonally between the adjacent two turbine buckets to connect them together. When this type of bucket cover attachment is used, the downstream trailing end portion of a bucket is connected to the upstream leading end portion of an adjacent bucket by means of the diagonal cover piece which is secured at opposite ends thereof to the adjacent two buckets. More specifically, a transverse hole is formed in the trailing end portion and the leading end portion of the turbine bucket, and a transverse hole is also formed in the leading end portion and the trailing end portion of the adjacent bucket. The cover piece is formed at its opposite end portions with horizontal projections, one of such projections being received in the transverse hole formed in the leading end portion of one of the adjacent two buckets and secured in place by caulking and the other projection being received in the transverse hole formed in the trailing end portion of the other bucket and secured in place by caulking, whereby the adjacent two buckets can be connected together by the cover piece.

The bucket cover attachment of the above-described construction has a disadvantage in that there is the danger of the cover piece being broken while in service, because the centrifugal force produced in the cover piece during rotation of the bucket wheel acts on the projections of the cover piece inserted in the horizontal holes formed in the turbine buckets and the turbine buckets are prevented from undergoing twisting and untwisting when centrifugal force is exerted thereon during rotation of the bucket wheel.

An object of this invention is to provide a bucket cover attachment for connecting turbine buckets together which enables the turbine buckets to move relative to one another.

Another object of the invention is to provide a bucket cover attachment for connecting turbine buckets together which does not prevent the turbine buckets from undergoing twisting and untwisting.

Another object of the invention is to provide a bucket cover attachment for connecting turbine buckets together which does not prevent the turbine buckets from undergoing twisting and untwisting and which is effective to damp the vibration of the turbine buckets.

Still another object of the invention is to provide a bucket cover attachment for connecting turbine buckets together which permits a certain degree of movements of the buckets to take place and in which no problem is encountered with regard to the strength of the bucket wheel.

The outstanding characteristics of the invention are that a ledge is formed at the upper end of each of a plurality of turbine buckets arranged annularly, and a cover piece extends between ends of the adjacent two turbine buckets. The ledge includes a leading end portion and a trailing end portion each formed with a vertical hole, and the cover piece is formed with a plurality of cylindrical projections adapted to be received in the vertical holes formed in the ledges of the adjacent two turbine buckets, the two cylindrical projections being loosely fitted in the respective vertical holes and at least one of the projections having the diameter of its upper end portion increased so as to prevent dislodging of the projection from the hole. The cover piece is further formed on its upper surface with contact surfaces interposed between the projections and adapted to come into contact with the ledges, whereby displacements of the turbine buckets can be permitted to take place.

Figure 1:
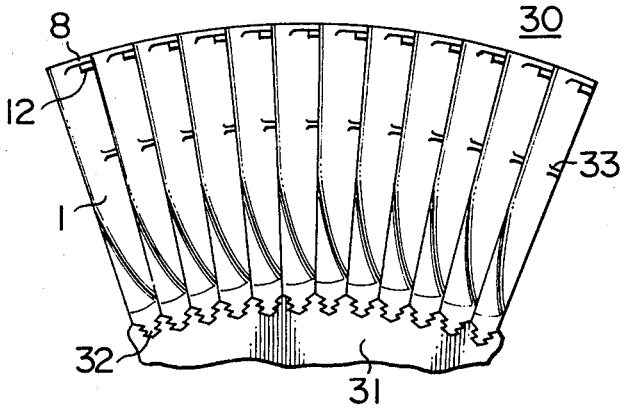
FIG. 1 is a fragmentary front view of a turbine stage incorporating the present invention therein.

Referring to FIG. 1, the turbine bucket wheel generally identified by the reference numeral 30 comprises a rotor 31, and a plurality of turbine buckets 1 arranged annularly around the rotor 31. The turbine buckets 1 are secured to the turbine rotor 31 by a dovetail connection or other similar arrangement. Each turbine bucket 1 is provided, substantially in the radial central portion thereof, with a sleeve tie wire connection, so that relative movements of the turbine buckets can be permitted to take place to some extent when the turbine buckets undergo twisting and untwisting.

Figure 2:
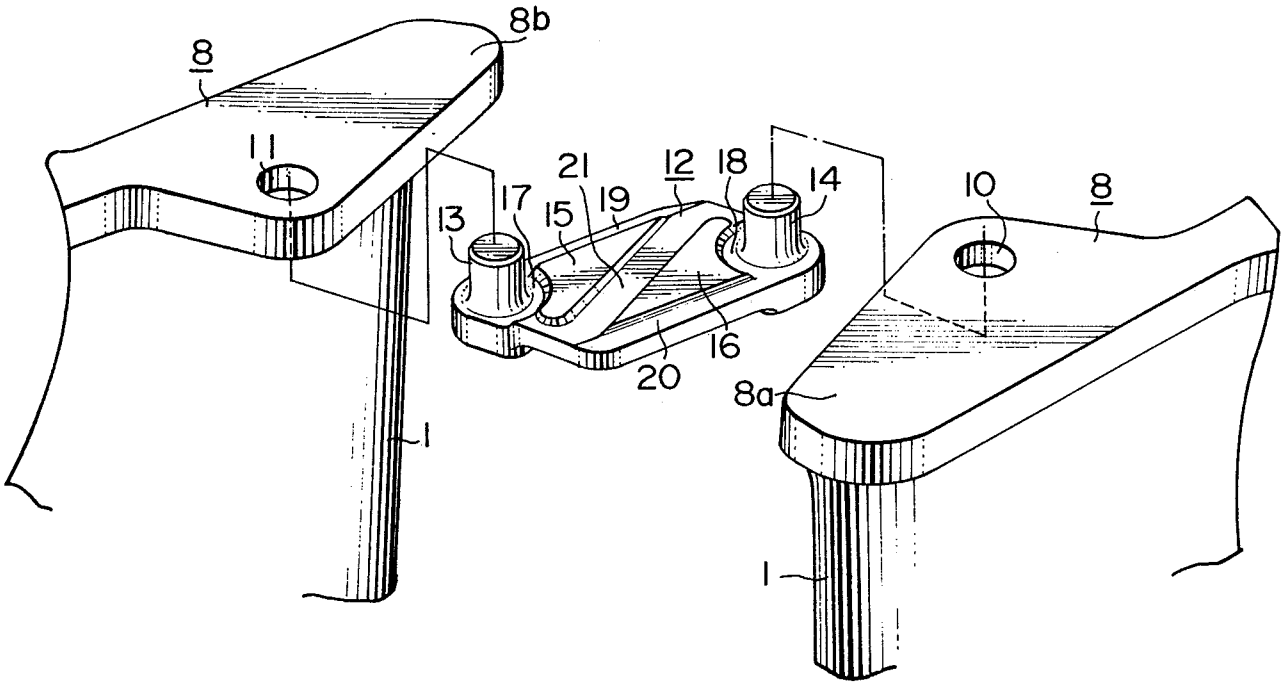
FIG. 2 is a perspective view of the bucket cover attachment according to the invention, showing the manner in which the cover piece is to be mounted on the turbine buckets.

In FIG. 2, a ledge 8 disposed at right angles to the outer surface of the bucket 1 is provided at the upper end of the bucket 1 and comprises a leading end portion **8*a* and a trailing end portion 8*b*, the leading end portion being disposed on the upstream side and the trailing end portion being disposed on the downstream side with respect to the stream of a fluid. The leading end portion 8*a* and the trailing end portion 8*b* of the ledge 8 of the bucket 1 extends in opposite directions on both sides of the bucket 1. The leading end portion 8*a* and the trailing end portion 8*b* of the ledge 8 are formed with vertical holes 10 and 11 respectively which extend through the ledge 8** from its upper surface to its underside.

A cover piece 12 for connecting together the adjacent two buckets 1, which is of a lozenge shape, is formed on its upper surface with two cylindrical projections 13 and 14 disposed diagonally at opposite corners of the cover piece 12. The cylindrical projection 13 of the cover piece 12 is adapted to be received in the vertical hole 11 formed in the trailing end portion **8*b* of the ledge 8 of one of the adjacent two buckets 1. The cylindrical projection 13 is loosely fitted in the hole 11 such that the former can rotate freely in the latter. The cylindrical projection 14 of the cover plate 12 is adapted to be received in the vertical hole 10 formed in the leading end portion 8***a* of the ledge 8 of the other bucket 1. After being loosely fitted in the hole 10, the cylindrical projection 14 has the diameter of its upper end portion increased as by caulking to prevent dislodging of the projection 14 from the hole 10. Except for the upper end portion, the cylindrical projection 14 is loosely fitted in the vertical hole 10, so that the projection 14 can rotate freely in the hole 10. It is to be understood that the cylindrical projection 13 may be inserted in the vertical hole 10 and the cylindrical projection 14 may be inserted in the hole 11 with the same effect.

Figure 3:
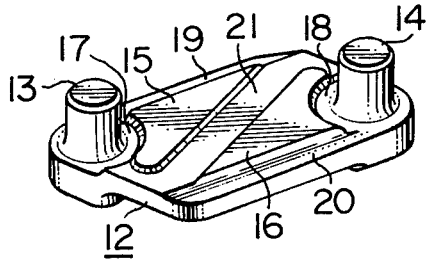
FIG. 3 is a top plan view of the cover piece according to the invention.
Figure 4:
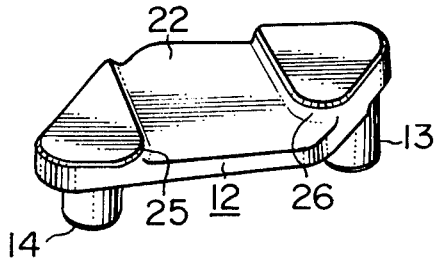
FIG. 4 is a bottom plan view of the cover piece according to the invention.

The construction of the cover piece 12 will be described more in detail. Referring to FIG. 3 and FIG. 4, contact surfaces 15 and 16 adapted to come into contact with undersides 8*c* of the ledges 8 of the adjacent two turbine buckets 1 are formed between the cylindrical projections 13 and 14 disposed diagonally at opposite corners on the upper surface of the cover piece 12 of the lozenge shape. The contact surface 15 is adapted to come into contact with the underside 8*c* of the trailing end portion 8*b* of the ledge 8, while the contact surface 16 is adapted to come into contact with the underside 8*c* of the leading end portion 8*a* of the ledge 8. A groove 21 is formed between the contact surfaces 15 and 16 to separate the two contact surfaces from one another, so that any difference in height which might be produced between the two contact surfaces 15 and 16 will not prevent one contact surface from being brought into intimate contact with the underside of the ledge.

The projections 13 and 14 are formed around their roots with circularly arcuate grooves 17 and 18 respectively so as to avoid the concentration of stress in the roots of the projections. Meanwhile a groove 22 of a large width disposed obliquely is formed on the underside of the cover piece 12 for guiding the stream of the fluid flowing down the turbine as well as for reducing the weight of the cover piece. The portions of side walls of the groove 22 disposed on the steam inlet side are chamfered to provide arcuate portions 25 and 26 so as not to disturb the flow of the fluid. Inclined surfaces 19 and 20 are formed on two sides of the cover piece disposed longitudinally thereof so as to raise the pressure at which the contact surfaces 15 and 16 are brought into contact with the ledges. By this arrangement, the contact surfaces 15 and 16 can be kept in good surface-to-surface contact with the undersides 8*c* of the ledges 8 of the adjacent buckets 1.

Figure 5:
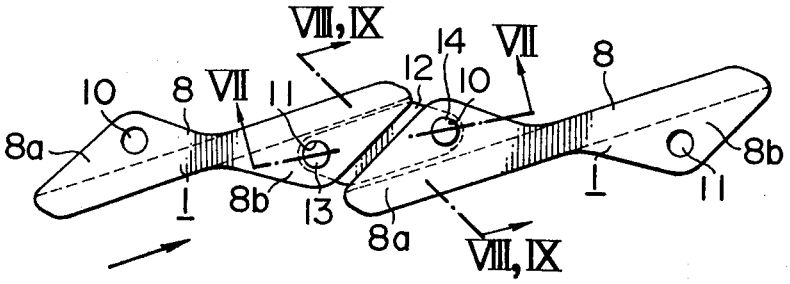
FIG. 5 is a plan view, as seen radially from outside of the turbine stage shown in FIG. 1, of the bucket cover attachment mounted on two turbine buckets of the turbine stage.
Figure 6:
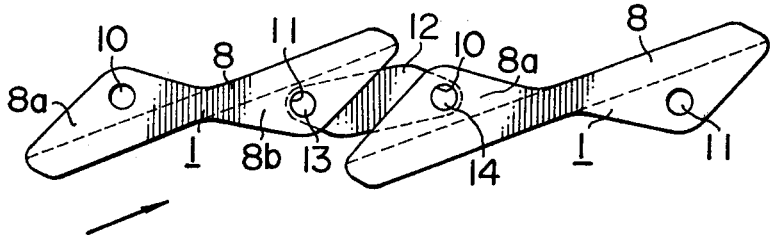
FIG. 6 is a plan view showing the bucket cover attachment mounted on the turbine buckets shown in FIG. 5 which are subjected to twisting and untwisting.
Figure 7:
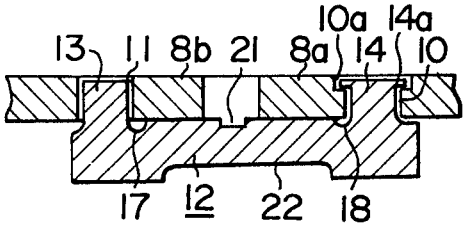
FIG. 7 is a fragmentary sectional view taken along the line VII—VII of FIG. 5.

FIG. 5 and FIG. 6 show the adjacent two turbine buckets as seen from outside radially of the bucket wheel. FIG. 6 shows the turbine buckets undergoing twisting and untwisting. As shown, the cover piece 12 connects the adjacent two turbine buckets together. FIG. 7 shows the manner in which the cover piece 12 is connected to the bucket 1. One projection 13 formed on the cover piece 12 is inserted in the vertical hole 11 formed in the trailing end portion 8*b* of the ledge 8 of the bucket 1, with a sufficiently large clearance being formed between the projection 13 and the wall of the hole 11 to permit the projection to rotate freely in the hole. The other projection 14 formed on the cover piece 12 is inserted in the vertical hole 10 formed in the leading end portion 8*a* of the ledge 8 of the adjacent bucket 1, with a sufficiently large clearance also being formed between the projection 14 and the wall of the hole 10 to permit the projection to rotate freely in the hole. The projection 14 is formed at its upper end portion with an enlarged diameter projection portion 14*a* as by caulking after the projection 14 is inserted in the hole. An enlarged diameter hole portion 10*a* is also formed at the upper end portion of the hole 10 so as to accommodate the enlarged diameter projection portion 14*a*. This arrangement prevents dislodging of the projection 14 from the hole 10 and thus ensures positive connection of the cover piece 12 to the leading end portion of the ledge of the turbine bucket.

It will be appreciated from the foregoing description that the adjacent two turbine buckets 1 are connected together by the cover piece 12 in a manner such that the projections 13 and 14 of the cover piece 12 can rotate freely in the vertical holes 11 and 10 respectively of the ledges 8 even if the turbine buckets 1 undergo twisting and untwisting as shown in FIG. 6. By this arrangement, damage to the cover piece can be avoided because the cover piece does not interfere with the displacements of the buckets when the latter undergo twisting and untwisting.

The cover piece 12 of the lozenge shape is maintained in intimate contact with the undersides 8*c* of the ledges 8 of the adjacent two turbine buckets 1 at the contact surfaces 15 and 16 which are formed on the upper surface of the cover piece 12 and separated from each other by the groove 21. The acruate grooves 17 and 18 are formed around the roots of the projections 13 and 14 respectively. This keeps the roots of the projections 13 and 14 from being brought into contact with the ledges 8, thereby permitting the contact surfaces 15 and 16 to be maintained in intimate surface-to-surface contact with the undersides 8*c* of the ledges 8. In the event stress is applied to the projections 13 and 14, concentration of the stress in the roots of the projections 13 and 14 can be avoided by the arcuate grooves 17 and 18, thereby increasing safety.

Figure 8:
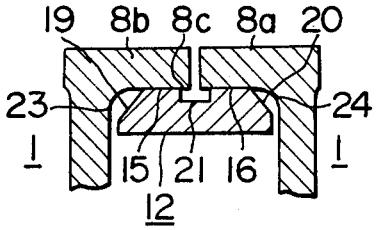
FIG. 8 and FIG. 9 are fragmentary sectional views taken along the lines VIII—VIII and IX—IX respectively of FIG. 5.
Figure 9:
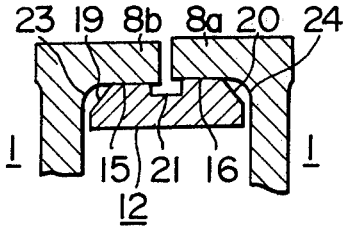

FIG. 8 and FIG. 9 show the manner in which the cover piece 12 is maintained in contact with the ends of the ledges of the adjacent two turbine buckets 1. As shown, the contact surface 15 of the cover piece 12 is maintained in contact with the underside 8*c* of the trailing end portion 8*b* of the ledge 8 of one of the adjacent two buckets 1, and the contact surface 16 thereof is maintained in contact with the underside 8*c* of the leading end portion 8*a* of the ledge 8 of the other bucket 1. The provision of the groove 21 between the contact surfaces 15 and 16 is effective to prevent the trailing end portion 8*b* and the leading end portion 8*a* of the ledges 8 from coming into contact with the contact surfaces 16 and 15 respectively. Even if there is a difference in level between the ledges of the adjacent two turbine buckets 1 due to an unavoidable error in machining or assembling as shown in FIG. 9, it is possible to bring the undersides of the trailing end portion and the leading end portion of the ledges into intimate surface-to-surface contact with the contact surfaces of the cover piece by providing the grooves 21 and varying the thickness of the contact surface 15 from that of the contact surface 16 in accordance with the difference in the level of the ledges between the trailing end portion 8*b* and the leading end portion 8*a* of the ledges 8 of the adjacent two buckets 1. Thus, the trouble of only one contact surface of the cover piece striking against the ledge can be avoided, and this has the effect of damping vibration which might be produced in the turbine buckets.

The leading end portion 8a of the ledge 8 and the body of the bucket 1 forms a corner 24 at the joint and the trailing end portion 8b of the ledge 8 and the body of the bucket 1 forms a corner 23 at the joint. As shown in FIG. 8 and FIG. 9, the corners 24 and 23 are generally rounded, in order that the strength of the ledges 1 to withstand the centrifugal force exerted on the leading end portion 8a and the trailing end portion 8b and the centrifugal force exerted on the cover plate 12 can be increased. On the other hand, the cover piece 12 is formed at the longitudinally extending opposite sides thereof with the inclined surfaces 19 and 20 so as to avoid contact between the cover piece 12 and the corners 23 and 24 when the cylindrical projections 14 and 13 rotate in the vertical holes 10 and 11 respectively by virtue of the hinging action. This increases the pressure at which the contact surfaces 15 and 16 of the cover piece 12 are brought into contact with the undersides of the ledges. This enables to obtain good surface-to-surface contact between the ledges 8 of the buckets 1 and the cover piece 12. Accordingly, the frictional force produced between the undersides 8c of the ledges 8 and the contact surfaces 15 and 16 of the cover piece 12 during rotation of the bucket wheel enables to damp the friction which might be produced in the turbine buckets 1.

Since the centrifugal force exerted on the cover piece 12 can be borne by the ledges 8 provided at the upper ends of the buckets 1, it is possible to reduce the weight of the cover piece 12 without adversely affecting the cover piece 12 from the point of view of strength. More specifically, the weight of the cover piece 12 is greatly reduced as a result of the provision of the groove 21 and the circularly arcuate grooves 17 and 18 formed on the upper surface of the cover piece 12, of the inclined surfaces 19 and 20 formed on the longitudinally extending sides thereof, and of the groove 22 of a large width formed on the underside thereof. Particularly, the provision of the groove 22 of a large width formed on the underside of the cover piece 12 contributes greatly to a reduction of the weight of the cover piece 12. The groove 22 is aligned substantially with the direction in which the stream of the fluid is introduced into the turbine. As aforesaid, the portions of the side walls of the groove 22 disposed on the fluid inlet side are chamfered to provide arcuate portions 25 and 26 so as not to disturb the flow of the fluid.

From the foregoing description, it will be appreciated that the bucket cover attachment in accordance with the present invention offers the advantage of being able to damp vibration of the turbine buckets because the turbine buckets can be maintained in good surface-to-surface contact with the cover piece. An additional advantage is that the cover piece has a structure which ensures high strength and increased safety in operation.

We claim:

1. A bucket cover attachment for turbine buckets annularly arranged around a rotor to constitute a turbine bucket wheel for a steam turbine, such bucket cover attachment comprising:

a plurality of ledges, each provided at the upper end of one of said plurality of turbine buckets and disposed at right angles to an outer surface of the turbine bucket; and a plurality of bucket cover pieces, each interposed between ends of the adjacent two turbine buckets;

wherein the improvement comprises a leading end portion and a trailing end portion formed in each said ledge and extending in opposite directions on both sides of the turbine bucket, a plurality of vertical holes formed in said leading end portion and said trailing end portion of the ledge, a plurality of cylindrical projections formed on an upper surface of said bucket cover piece and adapted to be loosely received in the vertical holes formed in the ledges of the adjacent two turbine buckets, at least one of said projections being formed at its upper end with an enlarged diameter projection portion so that the bucket cover piece may be held in place by the turbine buckets, contact surfaces formed on the upper surface of said bucket cover piece and adapted to come into contact with the ledges of the adjacent two turbine buckets, and a groove interposed between said cylindrical projections for separating said contact surfaces on the upper surface of the bucket cover piece, whereby the contact surfaces can be positively brought into contact with the trailing end portion and leading end portion of the ledges of the adjacent two turbine buckets.

2. A bucket cover attachment as claimed in claim 1, wherein the improvement further comprises circularly arcuate grooves each formed around a root of one of said cylindrical projections formed on the upper surface of the bucket cover piece.

3. A bucket cover attachment as claimed in claim 2 wherein the improvement further comprises a fluid flow groove formed on the underside of the bucket cover piece and aligned with the stream of a fluid flowing down the turbine.

4. A bucket cover attachment as claimed in claim 1, wherein said groove is arranged along a diagonal line of each bucket cover piece.

5. A bucket cover attachment as claimed in claim 1, wherein inclined surfaces are formed on two sides of the bucket cover piece disposed longitudinally thereof so as to adjust the area of the contact surfaces and raise the surface pressure at which the contact surfaces are brought into contact with the undersides of the ledges, whereby vibration of the turbine buckets can be damped.

6. A bucket cover attachment as claimed in claim 1, wherein a fluid flow groove is formed on the underside of the bucket cover piece and aligned with the stream of a fluid flowing down the turbine.

7. A bucket cover attachment for turbine buckets annularly arranged around a rotor to constitute a turbine bucket wheel for a steam turbine such bucket cover attachment comprising:

a plurality of ledges each formed at the upper end of one of said plurality of turbine buckets and disposed at right angles to an outer surface of the turbine bucket, each said ledge being formed with a leading end portion and a trailing end portion extending in opposite directions on both sides of the turbine bucket, said leading end portion and said trailing end portion being formed therein with vertical holes; and a plurality of bucket cover pieces each interposed between the trailing end portion and the leading end portion of the ledges of the adjacent two turbine buckets for connecting them together, each said bucket cover piece being of a lozenge shape and formed on its upper surface with cylindrical projections disposed diagonally at opposite corners and adapted to be loosely inserted for rotation in said vertical holes formed in the trailing end portion and the leading end portion of the ledges of the adjacent two turbine buckets, said bucket cover piece also being formed on its upper surface with a plurality of contact surfaces adapted to come into contact with the undersides of the trailing end portion and the leading end portion respectively of the ledges of the adjacent two turbine buckets, at least one of the cylindrical projections inserted in said vertical holes having the diameter of its upper end portion increased to provide an enlarged diameter projection portion to thereby preclude dislodging of the cylindrical projection from the vertical hole whereby the bucket cover piece can be held in place by the turbine buckets.

8. A bucket cover attachment as claimed in claim 7, wherein circularly arcuate grooves are each formed around one of said cylindrical projections formed on the upper surface of the bucket cover piece.

9. A bucket cover attachment as claimed in claim 7, wherein a fluid flow groove is formed on the underside of the bucket cover piece and aligned with the stream of a fluid flowing down the turbine.

10. A bucket cover attachment as claimed in claim 7, wherein inclined surfaces are formed on two sides of the bucket cover piece disposed longitudinally thereof so as to adjust the area of the contact surfaces and raise the surface pressure at which the contact surfaces are brought into contact with the undersides of the ledges, whereby vibration of the turbine buckets can be damped.

11. A bucket cover attachment as claimed in claim 7, wherein at least one of the vertical holes formed in the leading end portion and the trailing end portion of the ledge has the diameter of its upper end portion increased so as to hold in place the enlarged diameter projection of the vertical projection received in said vertical hole.

12. A bucket cover attachment as claimed in claim 7, wherein the plurality of contact surfaces formed on the upper surface of the bucket cover piece and adapted to be brought into contact with the undersides of the trailing end portion and the leading end portion of the ledges of the adjacent two turbine buckets are separated from one another by a groove formed between said cylindrical projections.

13. A bucket cover attachment as claimed in claim 12, wherein said groove is arranged along a diagonal line of each bucket cover piece.

* * * * *